US009506000B2

(12) United States Patent
Croud et al.

(10) Patent No.: US 9,506,000 B2
(45) Date of Patent: Nov. 29, 2016

(54) TRACERS AND METHOD OF MARKING LIQUIDS

(71) Applicants: Vincent Brian Croud, South Yorkshire (GB); Ian Stuart Edworthy, Tyne & Wear (GB); Duncan McCallien, Durham (GB)

(72) Inventors: Vincent Brian Croud, South Yorkshire (GB); Ian Stuart Edworthy, Tyne & Wear (GB); Duncan McCallien, Durham (GB)

(73) Assignee: JOHNSON MATTHEY PUBLIC LIMITED COMPANY, London (GB)

( * ) Notice: Subject to any disclaimer, the term of this patent is extended or adjusted under 35 U.S.C. 154(b) by 51 days.

(21) Appl. No.: 14/370,229

(22) PCT Filed: Jan. 4, 2013

(86) PCT No.: PCT/GB2013/050011

§ 371 (c)(1),
(2) Date: Jul. 2, 2014

(87) PCT Pub. No.: WO2013/102766

PCT Pub. Date: Jul. 11, 2013

(65) Prior Publication Data

US 2014/0331547 A1 Nov. 13, 2014

(30) Foreign Application Priority Data

Jan. 6, 2012 (GB) ..... 1200184.8

(51) Int. Cl.

| | |
|---|---|
| ***C10L 1/223*** | (2006.01) |
| ***C10L 1/232*** | (2006.01) |
| ***C10L 1/00*** | (2006.01) |

(52) U.S. Cl.

CPC ..... *C10L 1/232* (2013.01); *C10L 1/003* (2013.01); *C10L 2230/16* (2013.01); *C10L 2270/02* (2013.01); *C10L 2270/023* (2013.01); *C10L 2270/026* (2013.01)

(58) Field of Classification Search

CPC .... C10L 1/232; C10L 1/003; C10L 2270/02; C10L 2230/16; C10L 2270/023; C10L 2270/026

See application file for complete search history.

(56) References Cited

U.S. PATENT DOCUMENTS

| | | | | |
|---|---|---|---|---|
| 4,666,455 | A | 5/1987 | Jost et al. | |
| 6,312,958 | B1 | 11/2001 | Meyer et al. | |
| 6,603,020 | B1 * | 8/2003 | Moretti | C09B 57/004 524/92 |
| 2009/0173916 | A1 * | 7/2009 | Yamamoto | C07D 487/04 252/301.16 |

FOREIGN PATENT DOCUMENTS

| | | | | |
|---|---|---|---|---|
| CH | EP 1087005 | A1 * | 3/2001 | C09K 11/06 |
| JP | 2-216457 | | 8/1990 | |
| WO | 03002672 | A2 | 1/2003 | |
| WO | 03022848 | A2 | 3/2003 | |
| WO | 2005040284 | A1 | 5/2005 | |
| WO | 2006061343 | A1 | 6/2006 | |
| WO | 2011054731 | A1 | 5/2011 | |

OTHER PUBLICATIONS

EIC Dec. 2015.*

International Search Report dated Mar. 14, 2013, corresponding to PCT/GB2013/050011.

T. Potrawa, et al.; "Fluoreszenzfarbstoffe Mit Grossen Stokes-Shifts-loesliche Dihydropyrrolopyrroldione"; vol. 120; Jan. 1, 1987; pp. 1075-1078.

Martin Vala, et al.; "Comparative Studies of Diphenyl-Diketo-Pyrrolopyrrole Derivatives for Electroluminescence Applications"; vol. 18, No. 6; May 22, 2008; pp. 1181-1186.

R.L. Riggs, et al.; "Synthetic Studies Related to Diketopyrrolopyrrole (DPP) Pigments. Part 3: Syntheses of tri- and tetra-aryl DPPs"; vol. 61, No. 47; Nov. 21, 2005; pp. 11230-11243.

GB Combined Search and Examination Report, dated May 8, 2013, from corresponding GB application.

* cited by examiner

*Primary Examiner* — Pamela H Weiss
(74) *Attorney, Agent, or Firm* — Young & Thompson

(57) ABSTRACT

Method of marking a hydrocarbon liquid includes: adding

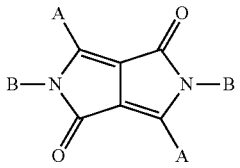

thereto, a tracer compound of Formula I:

wherein, each A is independently selected from the group consisting of (i) a phenyl group, (ii) a phenyl group substituted with one or more halogen atoms, an aliphatic group or a halogenated aliphatic group, (iii) a partially or fully halogenated alkyl group or (iv) a linear branched or cyclic $C_1$-$C_{20}$ alkyl group, and each B is independently selected from the group consisting of a (i) phenyl, (ii) phenylmethyl group, (iii) a cyclohexyl group, (iv) a cyclohexylmethyl group, (v) a substituted phenyl or phenylmethyl group in which the benzene ring is substituted by at least one substituent selected from the group consisting of a fluorine atom, a partially or fully halogenated alkyl group and a linear, branched or cyclic $C_1$-$C_{20}$ alkyl group or (vi) a linear, branched or cyclic $C_1$-$C_{20}$ alkyl group.

22 Claims, No Drawings

TRACERS AND METHOD OF MARKING LIQUIDS

The present invention concerns marking liquids, especially hydrocarbon liquids, with tracer materials. The present invention in particular concerns marking hydrocarbons which are taxable or liable to be subject to tampering or substitution, such as gasoline and diesel fuels for example.

It is well-known to add tracers to hydrocarbon liquids. A typical application is the tagging of hydrocarbon fuels in order to identify the fuel at a subsequent point in the supply chain. This may be done for operational reasons, e.g. to assist in distinguishing one grade of fuel from another, or for other reasons, in particular to ensure fuel quality, deter and detect adulteration and to provide a means to check that the correct tax has been paid. Apart from fuels, other products, such as vegetable oils may be marked to identify the product produced at a particular source, or certified to a particular standard.

One problem which is known to exist with the marking of fuel liquids in particular, is the potential for the tracer to be removed, by evaporation from the fuel, by degradation of the tracer through ageing or exposure to environmental conditions such as heat, sunlight or air or alternatively by deliberate removal of the tracer for unlawful purposes such as for avoidance of tax. Methods for deliberate removal of tracers include adsorption of the tracer onto common adsorbent materials such as charcoal or clays, exposure to radiation, such as ultraviolet light, oxidation etc. A useful fuel tracer therefore needs to be resistant to removal by these common methods and also to more sophisticated treatments such as treatment with acids and/or bases. It is an object of the invention to provide a method of marking hydrocarbon liquids which is more resistant to removal of the tracer than known methods.

In addition to being difficult to remove from the intended medium, tracer molecules should ideally possess a property which is different from that of the medium and which allows for their ready identification. Molecules exhibiting a characteristic fluorescent response that is at a different wavelength from that of the bulk medium are particularly suited for use as tracer molecules. Fluorescence is a useful property for the tracer molecule to possess as not only can it can be detected with hand-portable instrumentation but it usually can also detect the presence of fluorescent compounds at concentrations of parts per million, or less.

According to the invention we provide a method of marking a hydrocarbon liquid comprising the step of adding to said liquid, as a tracer compound, a compound Formula I

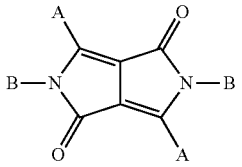

of Formula I, wherein, each A is independently selected from the group consisting of (i) a phenyl group, (ii) a phenyl group substituted with one or more halogen atoms, an aliphatic group or a halogenated aliphatic group, (iii) a partially or fully halogenated alkyl group or (iv) a linear, branched or cyclic $C_1$-$C_{20}$ alkyl group, and each B is independently selected from the group consisting of a (i) phenyl, (ii) a phenylmethyl group, (iii) a substituted phenyl group in which the benzene ring is substituted by at least one of the substituents selected from the group consisting of a fluorine atom, a partially- or fully-halogenated alkyl group and a linear, branched or cyclic $C_1$-$C_{20}$ alkyl group (iv) a substituted phenylmethyl group in which the benzene ring is substituted by at least one of the substituents selected from the group consisting of a fluorine atom, a partially or fully halogenated alkyl group and a linear, branched or cyclic $C_1$-$C_{20}$ alkyl group or (v) a linear, branched or cyclic $C_1$-$C_{20}$ alkyl group.

The hydrocarbon liquid may be a pure compound such as hexane or octane or it may comprise a mixture of compounds such as a distillation fraction having a particular range of boiling points. The hydrocarbon liquid may be intended for use as a chemical, a solvent or a fuel. The invention is of particular use for marking liquid hydrocarbon fuels such as gasoline and diesel fuels. In one particular application a low-tax fuel such as an agricultural diesel may be marked in order to detect any subsequent sale and use for purposes such as road-vehicle fuel which would normally be taxed more highly. In such cases unlawful dilution or substitution of a more highly taxed fuel with the low-taxed fuel may be detected by analysis of the highly taxed fuel to determine whether the tracer is present. Therefore in these cases, it is highly beneficial to use a tracer compound in the low-taxed fuel which is not easily removed, or laundered, from the fuel to a level at which it can no longer be detected. We have found that compounds of Formula I are resistant to removal from hydrocarbon fuels by several known methods of fuel laundering.

Preferably, when any of A or B contains a halogen or halogenated alkyl, the halogen atom is fluorine and the halogenated alkyl group is a fluoroalkyl group. The halogenated alkyl group(s) may be partially or fully halogenated, linear or branched, acyclic or cyclic aliphatic groups. Preferred halogenated alkyl groups include trifluoromethyl, 1,1-difluoroethyl, fluoroallyl, heptafluoropropyl, tridecafluorohexyl, heptadecafluorooctyl. When A or B contains a halogen-substituted benzene ring, it is preferred that the ring is substituted with at least three, preferably at least four, especially five halogen atoms.

In Formula I, alkyl group substituents may be straight chain or branched acyclic or cyclic aliphatic groups, preferably consisting of 4-12 carbon atoms. Branched or cyclic aliphatic groups are preferred. Particularly preferred are substituents which include at least one quaternary substituted carbon atom, such as tertiary butyl. Preferred groups include tert-butyl, 1,1-dimethylpropyl, 2,2-dimethylpropyl (neo-pentyl), 1,1-dimethylbutyl, 1-ethyl-1-methylpropyl, 2,2-dimethylbutyl, 1,1,2-trimethylpropyl, 1,2,2-trimethylpropyl, 1-ethyl-2,2-dimethylpropyl, 1-methylethyl-2,2-dimethylpropyl, 1,1,3,3-tetramethylbutyl, cyclopentyl, cyclohexyl, 2-methylcyclohexyl, 3-methylcyclohexyl, 4-methylcyclohexyl, cyclohexylmethyl, 2-ethylhexyl, 1-adamantyl, 2-adamantyl and decahydronaphthyl groups.

Each A is independently selected from the group consisting of (i) a phenyl group, (ii) a phenyl group substituted with one or more halogen atoms, an aliphatic group or a halogenated aliphatic group, (iii) a partially or fully halogenated alkyl group or (iv) a linear branched or cyclic $C_1$-$C_{20}$ alkyl group. A is most preferably selected from a phenyl group, optionally substituted with at least one halogen, alkyl group and/or a halogenated alkyl group. For example A may be selected from perfluorophenyl, bis(trifluoromethyl)phenyl or bis(t-butyl)phenyl. In preferred embodiments, each of the two A groups in the tracer compound has an identical composition.

Preferably each B is independently selected from the group consisting of (i) a phenylmethyl group, (ii) a substituted phenyl group in which the benzene ring is substituted by at least one of the substituents selected from the group consisting of a fluorine atom, a partially- or fully-halogenated alkyl group and a linear, branched or cyclic $C_1$-$C_{20}$ alkyl group (iii) a substituted phenylmethyl group in which the benzene ring is substituted by at least one of the substituents selected from the group consisting of a fluorine atom, a partially or fully halogenated alkyl group and a linear, branched or cyclic $C_1$-$C_{20}$ alkyl group or (iv) a cyclic $C_1$-$C_{20}$ alkyl group.B is most preferably a cyclohexylmethyl group, a perfluorophenyl group, a phenylmethyl group or a substituted phenylmethyl group in which the benzene ring is substituted with at least one $C_1$-$C_6$ alkyl group, a fluorine atom or a halogenated alkyl group, especially a trifluoromethyl group. In preferred embodiments, each of the two B groups in the tracer compound has an identical composition.

In a further preferred embodiment, each of the two A groups in the tracer compound has an identical composition to each other and each of the two B groups in the tracer compound has an identical composition to each other.

Usually, but not necessarily, the A groups are of a different composition from that of the B groups.

The tracer compounds are derivatives of 3,6-diphenyl-2,5-dihydropyrrolo[3,4-c]pyrrole-1,4-dione, known as C.I. Pigment Red 255. In Formula 1, substituent A is at the 3 and 6 positions; substituent(s) B are at the 2 and 5 positions.

Preferred compounds include:

(a) 3,6-diphenyl-2,5-di([pentafluorophenyl]methyppyrrolo[3,4-c]pyrrole-1,4-dione (b) 3,6-diphenyl-2,5-di([3,5-bistrifluoromethylphenyl]methyl)pyrrolo[3,4-c]pyrrole-1,4-dione (c) 3,6-diphenyl-2,5-di([3,5-bis(t-butyl)-phenyl]methyl)pyrrolo[3,4-c]pyrrole-1,4-dione (d) 3,6-di(3,5-bistrifluoromethylphenyl)-2,5-di(cyclohexylmethyl)pyrrolo[3,4-c]pyrrole-1,4-dione.

The tracer compound is added to the hydrocarbon liquid in such an amount as to provide a concentration of the tracer compound which is detectable by readily available laboratory methods capable of identifying the tracer compound in the liquid at the concentrations used. Suitable methods include, but are not limited to, (i) gas chromatography coupled with a suitable detector such as an electron capture detector or a mass spectrometer, (ii) fluorescence spectroscopy. Typical concentrations are within the range 1 μg/l to 1000 μg/l, the actual amount used depending on the detection method and limit of detection of the particular tracer compound used. The tracer compound may be present at a higher concentration than 1000 μg/l although when the product to be marked is a high-volume commodity such as a motor-fuel, economic considerations usually favour lower levels of tracer compound. The tracer compound may be supplied in the form of a concentrated dosing solution (or master-batch) of the tracer compound in a solvent. In this case the preferred solvent is a liquid which is similar to the liquid to be marked, although a different solvent, e.g. a hexane or mixed paraffins solvent may be used provided the presence of such a solvent can be tolerated in the hydrocarbon liquid to be marked. The concentrated dosing solution can be added to the hydrocarbon liquid to be marked so as to produce the required final concentration of the tracer compound by dilution. More than one tracer compound may be added to the liquid.

The selected tracer compound(s) is resistant to laundering by adsorption on activated charcoal or clay. In a preferred embodiment, at least 10%, more preferably at least 20% of the tracer compound is retained in the hydrocarbon liquid after a 10 ml sample of the liquid containing the tracer compound has been shaken for 2 minutes with 0.5 g fresh activated charcoal. The test to be applied for resistance to laundering by adsorption on a solid adsorbent is described below.

Preferably at least 50% (more preferably at least 60%, especially at least 80%) of the tracer compound is retained in the hydrocarbon liquid after a 10 ml sample of the liquid containing the tracer compound has been shaken for 2 minutes with 0.5 g of fresh sepiolitic clay.

Preferably the selected tracer compound(s) is resistant to laundering by chemical treatment with an acid or a base. In preferred embodiments, at least 50% (more preferably at least 75%) of the tracer compound is retained in the hydrocarbon liquid after a sample of the liquid containing 1 mg/l of the tracer compound has been vigorously agitated in contact with an equal volume of 5% aqueous hydrochloric acid. More preferably, at least 50% (more preferably at least 75%) of the tracer compound is retained in the hydrocarbon liquid after a sample of the liquid containing 1 mg/l of the tracer compound has been vigorously agitated in contact with an equal volume of concentrated (36%) hydrochloric acid.

Preferably at least 50% (more preferably at least 75%) of the tracer compound is retained in the hydrocarbon liquid after a sample of the liquid containing 1 mg/l of the tracer compound has been vigorously agitated in contact with an equal volume of 5% aqueous sulphuric acid. More preferably, at least 50% of the tracer compound is retained in the hydrocarbon liquid after a sample of the liquid containing 1 mg/l of the tracer compound has been vigorously agitated in contact with 5% of the sample volume of concentrated sulphuric acid.

Preferably at least 50% (more preferably at least 75%) of the tracer compound is retained in the hydrocarbon liquid after a sample of the liquid containing 1 mg/l of the tracer compound has been vigorously agitated in contact with an equal volume of 5% aqueous nitric acid. More preferably, at least 50% (more preferably at least 70%) of the tracer compound is retained in the hydrocarbon liquid after a sample of the liquid containing 1 mg/l of the tracer compound has been vigorously agitated in contact with 5% of the sample volume of concentrated nitric acid.

Preferably at least 50% (more preferably at least 75%) of the tracer compound is retained in the hydrocarbon liquid after a sample of the liquid containing 1 mg/l of the tracer compound has been vigorously agitated in contact with an equal volume of 2M aqueous NaOH.

Preferably at least 50% of the tracer compound is retained in the hydrocarbon liquid after a sample of the liquid containing from 50 to 1000 μg/l of the tracer compound has been vigorously agitated in contact with an equal volume of 10% aqueous NaOCl solution.

EXAMPLES

In the Examples, the test methods which were used are described below. The tests were undertaken to determine how much of the tracer compounds was removed from liquid fuels by contact with either a solid absorbent or a liquid chemical. The liquid fuels used were (i) a commercial UK 95 gasoline and (ii) a synthetic test fuel, made by mixing together 76% iso-octane, 16% toluene, 5% t-butyl methylether and 3% ethanol (all vol/vol).

Detection of Tracers in Fuels by Fluorescence Spectrometry

Samples were analysed using a Jobin Yvon SPEX FluoroMax-3 fluorimeter. A small quantity of each sample (3 ml) was poured into a quartz glass cuvette and irradiated with excitation (Ex) light appropriate to the molecule under test. Excitation and emission slit widths of 2 nm were used. An emission (Em) acquisition spectrum was collected for each molecule and the fluorescent emission at the wavelength showing maximal emission was recorded.

The magnitude of the fluorescent emission of the tracer molecules is proportional to their concentration up to and slightly above 1 mg/L for the molecules under test. This means that tracer concentration may be ascertained by reference to the fluorescent response of a known concentration of the tracer. In practice, the known tracer concentration is the starting concentration of tracer in the hydrocarbon under test. An initial fluorescence spectrum of the tracer is collected, the liquid is subjected to some form of tracer removal treatment and then the fluorescence spectrum of the tracer is re-measured. The ratio of the fluorescent emission after treatment to the emission before treatment is the same as the ratio of tracer concentration after treatment to that before treatment. The ratio of tracer after treatment to beforehand is simply denoted as percentage tracer remaining.

In some examples, the concentration of tracer after treatment is apparently more than before treatment. This is a result of the background fluorescence of the medium being altered by the tracer removal treatment. It may be difficult to compensate for this change in the background fluorescence, which in turn might lead to an apparent increase in tracer fluorescence, and by implication, tracer concentration.

The tracer compounds used were:

| | | Fluorescence spectrometry conditions | |
|---|---|---|---|
| | | Ex (nm) | Em (nm) |
| (a) | 3,6-diphenyl-2,5-di([pentafluorophenyl]methyl) pyrrolo[3,4-c]pyrrole-1,4-dione | in fuel ii 470 | 510 |
| | | in fuel i 480 | 510 |
| (b) | 3,6-diphenyl-2,5-di([3,5-bistrifluoromethylphenyl]methyl)pyrrolo[3,4-c]pyrrole-1,4-dione | in fuel ii 470 | 515 |
| | | in fuel i 490 | 520 |

-continued

| | | Fluorescence spectrometry conditions Ex (nm) | Em (nm) |
|---|---|---|---|
| (c) | 3,6-diphenyl-2,5-di([3,5-bis(t-butyl)-phenyl]methyl)pyrrolo[3,4-c]pyrrole-1,4-dione | in fuel ii 470 | 520 |
| | | in fuel i 490 | 520 |
| (d) | 3,6-di(3,5-bistrifluoromethylphenyl)-2,5-di(cyclohexylmethyl)pyrrolo[3,4-c]pyrrole-1,4-dione | in fuel ii 500 | 540 |
| | | in fuel i 500 | 545 |

Test for Resistance to Removal by a Solid Adsorbant (Charcoal or Sepiolitic Clay)

The adsorbents used were:

Charcoal: Activated charcoal (decolourising) from Sigma Aldrich (product number 161551), Sepiolitic clay: a pure, fine sepiolite clay from RS Minerals.

10 ml of liquid fuel marked with the test tracer compound at the concentration indicated was shaken vigorously for 1 minute with 0.5 g of the adsorbent. The mixture was allowed to stand for 1 minute and then shaken for a further minute before being filtered to remove the adsorbent. A sample of the fuel was analysed by fluorescence spectrometry and the percentage of the tracer remaining in the treated fuel is shown in Tables 1 & 2.

Test for Resistance to Removal by Liquid Chemical Treatment 10 ml of liquid fuel marked with the test tracer compound at the concentration indicated was shaken vigorously for 1 minute with a volume of a chemical agent as shown in Tables 1&2. The mixture was allowed to stand for 1 minute and then shaken for a further minute before being left to separate in two layers. A sample of the fuel was analysed by fluorescence spectrometry and the percentage of the tracer remaining in the treated fuel is shown in Tables 1&2.

Example 1

Preparation of 3,6-diphenyl-2,5-di([pentafluorophenyl]methyl)pyrrolo[3,4-c]pyrrole-1,4-dione A suspension of C.I. Pigment Red 255 (0.14 g, 0.5 mmol) in dimethyl formamide (15 ml) was prepared in a nitrogen-purged vessel. Sodium tert-butoxide (0.12 g, 1.25 mmol) was added, resulting in a colour change from red to purple. The mixture was stirred at room temperature for 20 minutes before addition of pentafluorobenzyl bromide (0.52 g, 2.00 mmol) to the reaction mixture which was heated at 80° C. After 1 hour, thin-layer chromatography (TLC) analysis of the reaction mixture [$SiO_2$ plate, (2:1) cyclohexane:ethyl acetate eluent] showed no starting material remained in the mixture. The reaction was then allowed to cool to room temperature, diluted with water (20 ml) and extracted with dichloromethane (DCM) (2×20 ml). The organic extracts were dried over magnesium sulfate and concentrated at reduced pressure to afford an orange solid (0.46 g). The product was purified by recrystallisation from xylene which gave an orange solid (0.2 g, 62% yield). The crude product, compound (a), was then used as a tracer in fuel samples which were tested to assess the degree to which it could be removed by the laundering methods described above. The results are shown in Table 1.

Example 2

Preparation of 3,6-diphenyl-2,5-di([3,5-bistrifluoromethylphenyl]methyl)pyrrolo[3,4-c]pyrrole-1,4-dione A suspension of C.I. Pigment Red 255 (0.14 g, 0.5 mmol) in dimethyl formamide (15 ml) was prepared in a nitrogen-purged vessel. Sodium tert-butoxide (0.12 g, 1.25 mmol) was added, resulting in a colour change from red to purple. The mixture was stirred at room temperature for 20 minutes. 3,5-bis(trifluoromethyl)benzyl bromide (0.3 ml, 1.63 mmol) was then added to the reaction mixture which was stirred at room-temperature overnight. TLC analysis of the reaction mixture [$SiO_2$ plate, (2:1) cyclohexane:ethyl acetate as eluent] showed no starting material remained in the mixture. The reaction mixture was then diluted with xylene (20 ml) and water (20 ml). The organic layer was separated, washed with water (20 ml), dried over magnesium sulfate and concentrated at reduced pressure to afford an orange solid (0.49 g). The product was purified by recrystallisation from hot xylene, giving an orange solid (one spot by TLC analysis).

The crude product, compound (b), was then used as a tracer in fuel samples which were tested to assess the degree to which it could be removed by the laundering methods described above. The results are shown in Table 1.

Example 3

Preparation of 3,6-diphenyl-2,5-di([3,5-bis(t-butyl)-phenyl]methyl)pyrrolo[3,4-c]pyrrole-1,4-dione A suspension of C.I. Pigment Red 255 (0.14 g, 0.5 mmol) in dimethyl formamide (15 ml) was prepared in a nitrogen-purged vessel. Sodium tert-butoxide (0.12 g, 1.25 mmol) was added, resulting in a colour change from red to purple. The mixture was stirred at room temperature for 20 minutes. 3,5-di-tert-butylbenzyl bromide (0.3 ml, 1.63mmol) was then added to the reaction mixture which was stirred at room temperature overnight. TLC analysis of the reaction mixture [$SiO_2$ plate, (2:1) cyclohexane:ethyl acetate as eluent] showed no starting material remained in the mixture. The reaction mixture was then diluted with xylene (20 ml) and water (20 ml) added. The organic layer was separated, washed with water (20 ml), dried over magnesium sulfate and concentrated at reduced pressure to afford an orange solid, compound (c). The crude material was then dissolved in the minimum amount of hot cyclohexane and cooled to 3° C., resulting in precipitation of an orange powder. The solid was filtered and washed with cyclohexane (2×2 ml) to afford the pure product (0.17 g, 50% yield). Compound (c), was then used as a tracer in fuel samples which were tested to assess the degree to which it could be removed by the laundering methods described above. The results are shown in Table 1.

TABLE 1

| | | | Removal test | | | | | | | |
|---|---|---|---|---|---|---|---|---|---|---|
| Tracer cmpd | Conc (ppm) | Fuel | Charcoal | Sepiolitic clay | 36% HCl (1:1) | 10% NaOH (1:1) | 20% NaOH (1:1) | Conc. $H_2SO_4$ (1:19) | 5% $H_2SO_4$ (1:1) | Conc. $HNO_3$ (1:19) |
| a | 1 | ii | 13 | 101 | 99 | 102 | | 6 | 105 | 71 |
| a | 1 | i | 29 | 100 | 96 | 105 | | 81 | | 72 |
| b | 1 | ii | 39 | 100 | 104 | | 98 | 63 | 105 | 74 |
| b | 1 | i | 97 | 141 | 91 | | 92 | 113 | 95 | 66 |
| c | 1 | ii | 10 | 102 | 100 | | 109 | 79 | 104 | 77 |
| c | 1 | i | 39 | 102 | 104 | | 101 | 92 | 103 | 75 |

Example 4

3,6-Di(3,5-bistrifluoromethylphenyl)-2,5-di([cyclohexyl]methyl)pyrrolo[3,4-c]pyrrole-1,4-dione was used as a tracer in fuel samples which were tested to assess the degree to which they could be removed by the laundering methods described above. The results are shown in Table 2.

TABLE 2

| | | | Removal test | | | | | |
|---|---|---|---|---|---|---|---|---|
| Tracer cmpd | Conc (ppm) | Fuel | Charcoal | Sepiolitic clay | 5% HCl (1:1) | 8% NaOH (1:1) | 2M KOH (1:1) | Conc. $H_2SO_4$ (1:19) |
| d | 1 | ii | 5 | 101 | 103 | 92 | | |
| d | 1 | i | 26 | 99 | 105 | | 88 | 55 |

The invention claimed is:

1. A method of marking a hydrocarbon liquid, comprising the step of adding to said liquid, as a tracer compound, a compound of Formula I:

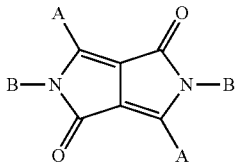

wherein, each A is independently selected from the group consisting of (i) a phenyl group, (ii) a phenyl group substituted with one or more halogen atoms, an aliphatic group or a halogenated aliphatic group, (iii) a partially or fully halogenated alkyl group and (iv) a linear branched or cyclic C1-C20 alkyl group, and each B is independently selected from the group consisting of (i) a phenyl group, (ii) an unsubstituted phenylmethyl group, (iii) a substituted phenyl or phenylmethyl group in which the benzene ring is substituted by at least one of the substituents selected from the group consisting of a fluorine atom, a partially or fully halogenated alkyl group and a linear, branched or cyclic C1-C20 alkyl group and (iv) a linear, branched or cyclic C1-C20 alkyl group, wherein said tracer compound is added to the liquid at a concentration in the range of from 1-1000 micrograms per liter.

2. The method according to claim 1, wherein after adding the tracer compound to said hydrocarbon liquid and mixing, at least 10% of the tracer compound is retained in the hydrocarbon liquid after a 10 ml sample of the liquid containing from 50 to 1000 μg/l of the tracer compound has been shaken for 2 minutes with 0.5 g of fresh activated charcoal.

3. The method according to claim 1, wherein after adding the tracer compound to said hydrocarbon liquid and mixing, at least 50% of the tracer compound is retained in the hydrocarbon liquid after a 10 ml sample of the liquid containing from 50 to 1000 μg/l of the tracer compound has been shaken for 2 minutes with 0.5 g of fresh powdered sepiolitic clay.

4. The method according to claim 1, wherein after adding the tracer compound to said hydrocarbon liquid and mixing, at least 50% of the tracer compound is retained in the hydrocarbon liquid after a sample of the liquid containing from 50 to 1000 μg/l of the tracer compound has been vigorously agitated in contact with an equal volume of up to 5% aqueous HCl.

5. The method according to claim 1, wherein after adding the tracer compound to said hydrocarbon liquid and mixing, at least 50% of the tracer compound is retained in the hydrocarbon liquid after a sample of the liquid containing from 50 to 1000 μg/l of the tracer compound has been vigorously agitated in contact with an equal volume of up to 5% aqueous $H_2SO_4$.

6. The method according to claim 1, wherein after adding the tracer compound to said hydrocarbon liquid and mixing, at least 50% of the tracer compound is retained in the hydrocarbon liquid after a sample of the liquid containing from 50 to 1000 μg/l of the tracer compound has been vigorously agitated in contact with an equal volume of up to 5% aqueous $HNO_3$.

7. The method according to claim 1, wherein after adding the tracer compound to said hydrocarbon liquid and mixing, at least 50% of the tracer compound is retained in the hydrocarbon liquid after a sample of the liquid containing from 50 to 1000 μg/l of the tracer compound has been vigorously agitated in contact with 2 Molar aqueous sodium hydroxide solution.

8. The method according to claim 1, wherein each A is selected from the group consisting of (i) a phenyl group, and (ii) a substituted phenyl group substituted with at least one halogen, alkyl group or halogenated alkyl group.

9. The method according to claim 8, wherein each A is selected from phenyl, pentafluorophenyl, bis(trifluoromethyl)phenyl or bis(t-butyl)phenyl.

10. The method according to claim 1, wherein each B is independently selected from:

a phenyl group;

an unsubstituted phenylmethyl group;

a phenylmethyl group in which the benzene ring is substituted by at least one $C_1$-$C_6$ alkyl group, fluorine or halogenated alkyl group; or a cyclohexylmethyl group.

11. The method according to claim 1, wherein the tracer compounds are selected from the group consisting of:

(a) 3,6-diphenyl-2,5-di([pentafluorophenyl]methyl)pyrrolo[3,4-c]pyrrole-1,4-dione, (b) 3,6-diphenyl-2,5-di([3,5-bistrifluoromethylphenyl]methyl)pyrrolo[3,4-c]pyrrole-1,4-dione, (c) 3,6-diphenyl-2,5-di([3,5-bis(t-butyl)-phenyl]methyl)pyrrolo[3,4-c]pyrrole-1,4-dione, and (d) 3,6-Di(3,5-bistrifluoromethylphenyl)-2,5-di(cyclohexylmethyl)pyrrolo[3,4-c]pyrrole-1,4-dione.

12. The method according to claim 1, wherein the hydrocarbon liquid contains more than one tracer compound.

13. The method according to claim 1, wherein the hydrocarbon liquid comprises a diesel fuel, a gasoline fuel or a solvent.

14. The method according to claim 1, wherein the tracer compound is added to the hydrocarbon liquid in the form of a concentrated dosing solution of the tracer compound in a solvent.

15. A liquid composition comprising a mixture of a hydrocarbon liquid and from 1 μg/l to 10 mg/l of a tracer compound, wherein said tracer compound comprises a compound of Formula I:

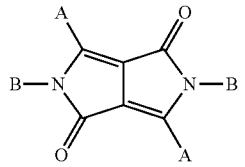

wherein, each A is independently selected from the group consisting of (i) a phenyl group, (ii) a phenyl group substituted with one or more halogen atoms, an aliphatic group or a halogenated aliphatic group, (iii) a partially or fully halogenated alkyl group or (iv) a linear branched or cyclic $C_1$-$C_{20}$ alkyl group, and each B is independently selected from the group consisting of (i) a phenyl group, (ii) an unsubstituted phenylmethyl group, (iii) a substituted phenyl or phenylmethyl group in which the benzene ring is substituted by at least one of the substituents selected from the group consisting of a fluorine atom, a partially or fully halogenated alkyl group and a linear, branched or cyclic $C_1$-$C_{20}$ alkyl group and (iv) a linear, branched or cyclic $C_1$-$C_{20}$ alkyl group.

16. The liquid composition according to claim 15, wherein each A is selected from a phenyl group, a substituted phenyl group substituted with at least one halogen, alkyl group or halogenated alkyl group.

17. The liquid composition according to claim 16, wherein each A is selected from pentafluorophenyl, bis(trifluoromethyl)phenyl or bis(t-butyl) phenyl.

18. The liquid composition according to claim 15, wherein each B is independently selected from:

a phenyl group;

unsubstituted phenylmethyl group;

a phenylmethyl group in which the benzene ring is substituted by at least one $C_1$-$C_6$ alkyl group, fluorine or halogenated alkyl group; or a cyclohexylmethyl group.

19. The liquid composition according to claim 15, wherein the tracer compound is selected from the group consisting of:

(a) 3,6-diphenyl-2,5-di([pentafluorophenyl]methyl)pyrrolo[3,4-c]pyrrole-1,4-dione (b) 3,6-diphenyl-2,5-di([3,5-bistrifluoromethylphenyl]methyl)pyrrolo[3,4-c]pyrrole-1,4-dione (c) 3,6-diphenyl-2,5-di([3,5-bis(t-butyl)-phenyl]methyl)pyrrolo[3,4-c]pyrrole-1,4-dione (d) 3,6-di(3,5-bistrifluoromethylphenyl)-2,5-di(cyclohexylmethyl)pyrrolo[3,4-c]pyrrole-1,4-dione.

20. The liquid composition according to claim 15, wherein the hydrocarbon liquid contains more than one tracer compound.

21. The liquid composition according to claim 15, wherein the hydrocarbon liquid comprises a diesel fuel, a gasoline fuel or a solvent.

22. A liquid composition made by the method of claim 1.

* * * * *